US006578623B2

(12) United States Patent
Keller et al.

(10) Patent No.: US 6,578,623 B2
(45) Date of Patent: Jun. 17, 2003

(54) CERAMIC CORE AND METHOD OF MAKING

(75) Inventors: Ronald J. Keller, Grand Haven, MI (US); Rodney S. Haaland, Morristown, TN (US); Julie A. Faison, Whitehall, MI (US)

(73) Assignee: Howmet Research Corporation, Whitehall, MI (US)

( * ) Notice: Subject to any disclaimer, the term of this patent is extended or adjusted under 35 U.S.C. 154(b) by 11 days.

(21) Appl. No.: 09/968,654

(22) Filed: Oct. 1, 2001

(65) Prior Publication Data

US 2002/0117601 A1 Aug. 29, 2002

Related U.S. Application Data

(62) Division of application No. 09/339,293, filed on Jun. 24, 1999, now Pat. No. 6,315,941.

(51) Int. Cl.[7] ..... B22C 9/10
(52) U.S. Cl. ..... 164/369; 249/175; 164/371
(58) Field of Search ..... 264/643, 654, 264/666, 225; 249/175; 164/369, 371

(56) References Cited

U.S. PATENT DOCUMENTS

| | | | | |
|---|---|---|---|---|
| 2,703,913 A | | 3/1955 | Hinde et al. | 22/196 |
| 2,792,604 A | | 5/1957 | Bartlett et al. | 22/193 |
| 2,961,751 A | | 11/1960 | Operhall et al. | 22/196 |
| 3,077,648 A | | 2/1963 | Sutherland | 22/193 |
| 3,204,917 A | | 9/1965 | Richards | 249/116 |
| 3,209,421 A | | 10/1965 | Shepherd | 22/196 |
| 3,326,269 A | | 6/1967 | Schneider | 164/43 |
| 3,426,832 A | | 2/1969 | Phillips et al. | 164/45 |
| 3,713,475 A | | 1/1973 | Roelofs et al. | 164/26 |
| 4,583,581 A | * | 4/1986 | Ferguson et al. | 164/529 |
| 4,624,898 A | | 11/1986 | Moore et al. | 428/446 |
| 4,703,806 A | | 11/1987 | Lassow et al. | 164/518 |
| 4,787,439 A | | 11/1988 | Feagin | 164/518 |
| 4,919,193 A | | 4/1990 | Sasaki | 164/516 |
| 4,921,038 A | | 5/1990 | Sasaki et al. | 164/516 |
| 4,947,927 A | | 8/1990 | Horton | 164/517 |
| 4,989,667 A | | 2/1991 | Kington | 164/519 |
| 4,998,581 A | | 3/1991 | Lane et al. | 164/517 |
| 5,391,606 A | | 2/1995 | Doles | 524/430 |

* cited by examiner

*Primary Examiner*—James Derrington

(57) ABSTRACT

Method of making a ceramic core for casting an industrial gas turbine engine airfoil having a large airfoil pitch by forming a precursor core (chill) of smaller dimensions than the final desired ceramic core, firing the chill, applying a thin ceramic skin to the fired chill to form a coated core of final dimensions, and then firing the coated core. Firing of the thin ceramic skin reduces airfoil pitch shrinkage resulting from the latter firing operation to reduce overall core dimensional tolerance variations.

2 Claims, 1 Drawing Sheet

CERAMIC CORE AND METHOD OF MAKING

This is a division of Ser. No. 09/339 293 filed Jun. 24, 1999, now U.S. Pat. No. 6,315,941.

FIELD OF THE INVENTION,

The present invention relates to ceramic cores for use in investment casting of metallic Industrial gas turbine engine blades and vanes having internal passageways and large airfoil pitch.

BACKGROUND OF THE INVENTION

In casting gas turbine engine blades and vanes using conventional equiaxed and directional solidification techniques, ceramic cores are positioned in an investment shell mold to form internal cooling passageways. During service in the gas turbine engine, cooling air is directed through the passageways to maintain blade temperature within an acceptable range. In manufacture of large gas turbine engine blades and vanes for industrial gas turbine engines, correspondingly larger ceramic cores are used to form the internal passages. The ceramic cores used in investment casting can be prone to distortion and loss of the required dimensional tolerance during core manufacture, especially of the airfoil core pitch. The problem of airfoil pitch distortion is greater for larger ceramic cores used in the manufacture of industrial gas turbine engines.

An object of the present invention is to provide a method of making a ceramic core and the core so made in a manner that reduces airfoil pitch shrinkage and loss of dimensional tolerance.

SUMMARY OF THE INVENTION

An embodiment of the present invention provides a method of making a ceramic core having an airfoil section for use in making a gas turbine engine airfoil casting by forming a precursor core (hereafter referred to as a chill) of smaller dimensions than the final desired ceramic core, firing the chill, applying a thin ceramic skin to the fired chill to form a coated core, and then firing the coated core. Firing shrinkage of the thin ceramic skin during the second firing operation is minimal compared to that of the chill in the first firing. Shrinkage, distortion and loss of dimensional tolerance of the airfoil pitch of the final core is thereby reduced.

The invention provides a ceramic core for use in making large industrial gas turbine engine airfoil castings having an airfoil pitch of one inch and greater and having an airfoil pitch shrinkage of the core of about 0.5% or less.

The above objects and advantages of the present invention will become more readily apparent, from the following detailed description taken with the following drawings.

DETAILED DESCRIPTION OF THE INVENTION

The invention provides a ceramic core especially useful in casting large industrial gas turbine engine (IGT) blades and vanes (airfoils). The core 20, FIG. 1B, has an airfoil section 21 with a pitch P of one (1) inch and greater where the pitch P is the maximum cross-sectional thickness of airfoil section taken on a plane perpendicular to a longitudinal axis (known as stack axis) of the airfoil section. The invention is especially useful in making ceramic cores that exhibit core airfoil pitch shrinkage of about 0.5% or less when made pursuant to the invention.

Figure 1A:
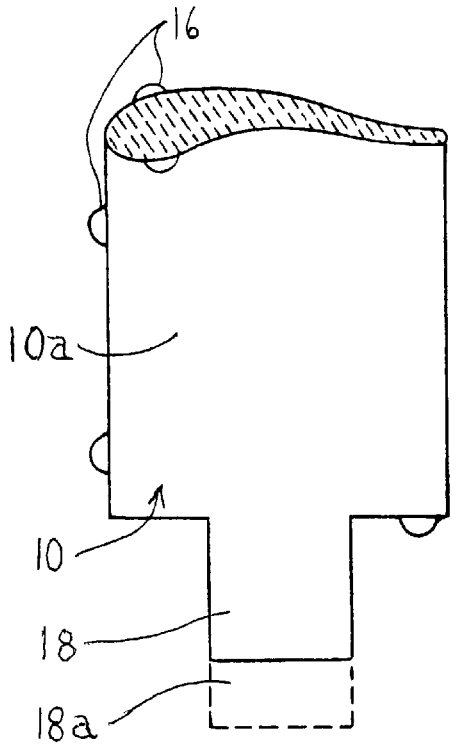
FIGS. 1A and 1B are schematic views of a method of making a ceramic core pursuant to an embodiment of the invention.
Figure 1B:
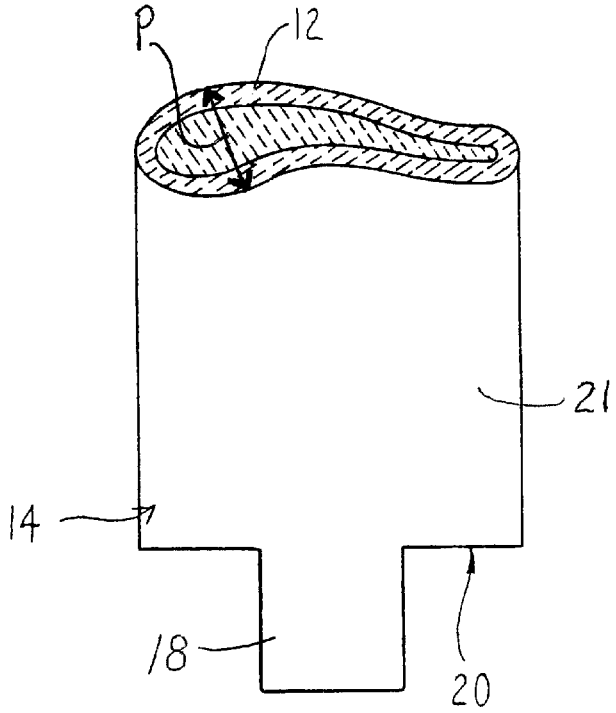

Referring to FIGS. 1A and 1B, an illustrative chill (precursor core) 10 of smaller dimensions than the final desired ceramic core 20 is shown and first formed by preparing a mixture of one or more suitable ceramic powders and a binder. The chill 10 includes airfoil shaped section 10*a*. The binder can be either an organometallic liquid, such as prehydrolized ethyl silicate, a thermoplastic wax-based binder, or a thermosetting resin mixed with ceramic powders in appropriate proportions to form a ceramic/binder mixture for molding to shape. The ceramic powders can be blended using a conventional V-cone blender, pneumatic blender, or other such blending equipment. The binder can be added using conventional high-shear mixing equipment at room temperature or elevated temperature. The ceramic powders may comprise alumina, silica, zirconia and other powders suitable for casting a particular metal or alloy. For example, the ceramic powders may have the following proportional ranges as a dry blend of powders:

| Dry Blend | Wt % Range |
|---|---|
| Continental Minerals −325 mesh Zircon | 15%–35% |
| Minco −200 mesh fused Silica (MinSil-40) | 15%–20% |
| CE Minerals Inc 10 micron Fused Silica | 12%–20% |
| CE Minerals −140/+325 mesh Fused Silica | 0%–30% |
| CE Minerals −70/+100 mesh Fused Silica | 10%–50% |

The zircon powder was available from Continental Minerals Processing Corporation, P.O. Box 62005, Cincinnati, Ohio, while the silica powders were available from Minco Inc., 510 Midway Circle, Midway, Tenn. and CE Minerals Inc., P.O. Box 1540, Snappferry Road, Greenville, Tenn.

A desired chill airfoil shape is formed by transferring the fluid ceramic/binder mixture into an aluminum or steel die either by injection or by pouring. The die defines a molding cavity having the chill configuration desired. The chill can be molded with integral conical protrusions 16 on the chill, FIG. 1A, and/or with an integral extension 18*a* of the chill core print 18 that allows the chill to be held in position in a final core die discussed below. The Injection pressures in the range of 500 psi to 2000 psi are used to pressurize the fluid ceramic/binder mixture in the molding cavity of the die. The dies may be cooled, held at room temperature, or slightly heated depending upon the complexity of the desired chill configuration. After the ceramic/binder mixture solidifies in the die, the die is opened, and the green, unfired chill is removed. The green, unfired chill then is subjected to a heat treatment with the chill positioned on a ceramic setter contoured to the shape of the chill. The ceramic setter, which includes a top half and a bottom half between which the chill is positioned, acts as a support for the chill and enables it to retain its shape during thermal processing. Sintering of the chill is achieved by means of this heat treatment to an elevated temperature based on the/requirements of the filler powders.

The fired chill then is positioned into the final core die such that the protrusions or "bumpers" 16 hold it off or away from the inner surface of the die, forming a small cavity between the chill and the final core die surface. The chill can be held away from the die surface using the protrusions 16 molded integrally on the chill, FIG. 1A, or using the extension 18*a* of the chill core print 18 that is adapted to be held in position in the die outside the molding cavity, or using positioning pins extending from the main core die. The ceramic skin 12 typically comprises the same or similar material used to form the chill. The ceramic skin is applied by either pouring or injecting a slurry of the ceramic material into the cavity formed between the die and the chill to have a constant thickness in the range of about 0.050 inch to 0.200 inch on all surfaces of the fired chill. The slurry can then be pressurized in the final core die to complete forming of the final core 14 having airfoil section 21, The final core 14 then is fired at elevated temperature based on requirements of the core materials. In some embodiments of the invention, the skin can be ignited to burn alcohols present in the binder and fired to an elevated temperature based on the requirements of the ceramic materials. As a result of the small thickness of the ceramic skin, there is little or essentially no firing shrinkage of the skin on the fired chill. This reduces or eliminates distortion due to proportional linear shrink of the widely varying cross-sections in core geometries used in casting. In particular, the coated cores (chill with ceramic skin), FIG. 1B, exhibit an airfoil pitch shrinkage of about 0.5% or less upon firing of the coated chill pursuant to the invention. In addition, the rigid fired chill provides body and stiffness to the core skin during firing to help minimize warping from firing.

The following Examples are offered to further illustrate, but not limit, the invention. In the Examples below, Wt % of ceramic powders is weight percent and −140/+325 mesh means greater than 140 mesh and less than 325 mesh powder and so on where mesh is U.S. standard sieve.

EXAMPLES

Example 1

One embodiment may be produced with a wax-injected ceramic chill, which is fired and used to produce the final core by pouring a liquid ceramic slurry around the fired chill. The binder for the chill car be made up of the thermoplastic wax-based material having a low melting temperature and composition of the type described in U.S. Pat. No. 4,837,187 incorporated herein by reference. The thermoplastic wax-based binder typically includes a thermoplastic wax, an anti-segregation agent, and a dispersing agent in proportions set forth in U.S. Pat. No. 4,837,187. A suitable thermoplastic wax for the binder is available as Durachem wax from Dura Commodities Corp., Harrison, N.Y. This wax exhibits a melting point of 165 degrees F. A strengthening wax can be added to the thermoplastic wax to provide the as-molded core with higher green strength. A suitable strengthening wax is available as Strahl & Pitsch 462-C from Strahl & Pitsch, Inc. West Babylon, N.Y. A suitable anti-segregation agent is an ethylene vinyl acetate copolymer such as DuPont Elvax 310 available from E. I. DuPont de Nemours Co., Wilimington, Del. A suitable dispersing agent is oleic acid. The ceramic powders can be blended using a conventional V-blender, pneumatic blender or other such blending equipment. The binder is added using high-shear mixing equipment at room temperature or elevated temperature as required by the melt temperature of the binder. The ceramic powders comprise silica and zircon in a 4:1 volumetric ratio. A desired chill shape is formed by injecting the ceramic/binder system into a steel die at elevated temperature and pressure. Injection pressures in the range of 500 psi to 2000 psi may be used to pressurize the fluid ceramic/binder mixture in the molding cavity. The die is typically held at temperatures ranging from 150 to 200 farenheight. After the ceramic/binder mixture solidifies in the molding cavity, the die is opened, and the green, unfired chill is removed. The green, unfired chill is placed in a ceramic setter contoured to the shape of the chill. A fine powdered material with a high surface area such as clay or graphite is placed on top of the chill while it is subjected to a prebake treatment designed to melt the wax binder. During this prebake treatment, the liquid binder is extracted from the chill into the powder through capillary action. A suitable prebake treatment may be conducted for approximately 5 hours at 550 to 600 degrees F. for a maximum turbine blade airfoil core thickness of approximately 2.2 inches. The chill in the ceramic setter is then covered with a top setter contoured to the shape of the top contour of the chill. The green chill with setter top and bottom is then fired or sintered to a temperature suitable to remove some of the porosity and impart a strength to the chill adequate for further processing. A suitable firing treatment may be conducted for approximately five hours at 2050 degrees F. The fired chill is then placed in the final cored die designed to produce the outer contour of the finished core. The "bumpers" designed into the chill rest against the surface of the core die and hold it a constant distance from the die on all surfaces. The final core is then formed by pouring a ceramic slurry into the die with the chill inside. The ceramic slurry encapsulates the chill and hardens onto it forming a skin. The ceramic powders used for the skin are comprised of the following:

| Dry Blend | Wt % |
|---|---|
| Continental Minerals −325 mesh Zircon | 30.28% |
| Minco −200 mesh fused Silica (MinSil-40) | 16.13% |
| CE Minerals Inc. 10 micron Fused Silica | 14.23% |
| CE Minerals −140/+325 mesh Fused Silica | 26.43% |
| CE Minerals −70/+100 mesh Fused Silica | 12.93% |

These ceramic powders are mixed with prehydrolised ethyl silicate (Remet R-25) in a ratio appropriate to form a low viscosity slurry. The solid/liquid ratio typically used is 4:1 resulting in a viscosity ranging from 700 to 1200 centipoise. Prior to pouring the ceramic slurry into the mold, it is combined with a basic catalyst such as ammonium hydroxide or morpholine which crosslinks the ethylsilicate producing a ceramic gel structure and effectively hardens the ceramic slurry in the shape of the core die cavity. The concentration of the catalyst is adjusted with water to allow for a working time of 3 to 5 minutes prior to hardening. The slurry/catalyst ratio typically used is 20:1 to 22:1 by volume. The slurry skin is ignited immediately upon opening the die (rapid heating to elevated temperature) to further harden the skin binder. After a 20 to 30 second burn, the flames are extinguished by a blast of air, and the green core is removed from the die. Once the core has been removed from the die, it is placed on a controlled surface and re-ignited and allowed to completely burn out. This combustion process allows the alcohols in the binder to be removed and further hardens the core surface. The coated core 14 then is fired at elevated temperature to complete the removal of any organics. A suitable firing cycle for the final core is conducted for approximately 1 to 2 hours at 1700 to 1800 degrees F. The core is then impregnated with silica by soaking it in a 30% by weight aqueous colloidal silica sol. This colloidal silica sol is commercially marketed under the DuPont Ludox trade name. The cores are then placed in a dryer held at 180 to 200 degrees F. until the water is sufficiently removed. These cores may be dipped and dried once or numerous times in order to fill the pour structure of the core with amorphous silica. After the final dry cycle the cores are loaded back into the firing setter. and subjected to a final sintering cycle for 1 to 2 hours at 1700 to 1800 degrees Fahrenheit.

Example 2

Another embodiment is comprised of a ceramic chill and skin both produced by pouring a liquid ceramic slurry into molds and subjected to sequential heat treatments. In this case, the binder for the chill is the same as that described above for the skin. The ceramic powders are comprised of the following formulation.

| Dry Blend | Wt % |
|---|---|
| Continental Minerals −325 mesh Zircon | 30.28% |
| Minco −200 mesh fused Silica (MinSil-40) | 16.13% |
| CE Minerals Inc. 10 micron Fused Silica | 14.23% |
| CE Minerals −140/+325 mesh Fused Silica | 26.43% |
| CE Minerals −70/+100 mesh Fused Silica | 12.93% |

The binder is mixed with the powders in a 4:1 weight ratio of powders to binder. A desired chill shape is formed by mixing the ceramic slurry with a catalyst in the manner described in example one, pouring or injecting the, ceramic/binder system into an aluminum die at room temperature and applying pressure by means of a hydraulic cylinder. Pressures in the range of 100 psi to 1000 psi may be used to pressurize the fluid ceramic/binder mixture in the molding cavity. After the ceramic/binder mixture solidifies in the molding cavity, the die is opened, and the chill is ignited as described in example one for the skin. After 20 to 30 seconds, the flames are extinguished, the chill removed from the die, placed on a contoured burn fixture, re-ignited, and allowed to burn out. The chill is then placed in a firing setter and fired to 1700 to 1800 degrees F. for 1 to 2 hours to remove the organics. It is then dipped in colloidal silica in order to harden it for subsequent use in the final core die. The fired chill is then placed in the final cored die designed to produce the outer contour of the finished cored. The final cored is then formed exactly as described in example 1 above.

Ten core test bars having a cross section thickness of 0.450" produced using example 2 exhibited an average pitch shrinkage of 0.43%. A core having a cross section thickness of 1.7" produced using example 2 exhibited a pitch shrinkage of 0.5%. The same core produced using no chill and the same material as in example 2 exhibited a pitch shrinkage of 6%.

Example 3

Another embodiment is comprised of a ceramic chill and skin both produced by pouring a liquid ceramic slurry into molds and subjected to sequential heat treatments. In this case, the binder for the chill is the same as that described above for the skin. The ceramic powders are comprised of the following formulation.

| Dry Blend | Wt. % |
|---|---|
| −325 mesh Zircon | 18.80% |
| −200 mesh Fused Silica (MinSil-40) | 17.28% |
| 10 micron Fused Silica | 15.24% |
| −70/+100 mesh Fused Silica | 48.67% |

The binder is mixed with the powders in a 4:1 weight ratio of powders to binder. A desired chill shaped is formed by mixing the ceramic slurry with a catalyst in a the manner described in example one, pouring or injecting the ceramic/binder system into an aluminum die at room temperature and applying pressure by means of a hydraulic cylinder. Pressures in the range of 100 psi to 1000 psi may be used to pressurize the fluid ceramic/binder mixture in the molding cavity. After the ceramic/binder mixture solidifies in the molding cavity, the die is opened, and the chill is ignited as described in example one for the skin, After 20 to 30 seconds, the flames are extinguished, the chill removed from the die, placed on a contoured burn fixture, re-ignited, and allowed to burn out. The chill is then dipped in colloidal silica as described for the core in example 1, placed in a firing setter and fired to 1700 to 1800 degrees F. for 1 to 2 hours to remove the organics. The fired chill is then placed in the final core die designed to produce the outer contour of the finished core. The final cores is then formed exactly as described in example 1 above.

Ten core test bars having a cross section thickness of 0.450" produced using example 2 exhibited an average pitch shrinkage of 0.3%. A core having a cross section thickness of 1.7" produced using example 2 exhibited a pitch shrinkage of 0.5%. The same core produced using no chill and the same material as in example 2 exhibited a pitch shrinkage of 1.6%.

Example 4

Another embodiment is comprised of a ceramic chill and skin both produced by pouring a liquid ceramic slurry into a mold, and upon removal from the mold, subjecting it to sequential heat treatments. In this case, the binder for the chill is the same as that described above for the skin. The ceramic powders are comprised of the following formulation.

| Dry Blend | Wt. % |
|---|---|
| −325 mesh Zircon | 18.80% |
| −200 mesh Fused Silica (MinSil-40) | 17.28% |
| 10 micron Fused Silica | 15.24% |
| −70/+100 mesh Fused Silica | 48.67% |

The binder is mixed with the powders in a 4:1 weight ratio of powders to binder. A desired chill shape is formed by mixing the ceramic slurry with a catalyst in the manner described in example one, pouring or injecting the ceramic/binder system into an aluminum die at room temperature and applying pressure by means of a hydraulic cylinder. Pressures in the range of 100 psi to 1000 psi may be used to pressurize the fluid ceramic/binder mixture in the molding cavity. After the ceramic/binder mixture solidifies in the molding cavity, the die is opened, and the chill is ignited as described in example one for the skin. After 20 to 30 seconds, the flames are extinguished, the chill removed from the die, placed on a contoured burn fixture, re-ignited, and allowed to burn out. The chill is then dipped in colloidal silica as described for the core in example 1, placed in a firing setter and fired to 1700. to 1800 degrees F. for 1 to 2 hours to remove the organics. The fired chill is then placed in the final core die designed to produce the outer contour of the finished core. The "bumpers" designed into the chill rest against the surface of the core die and hold it a constant distance from the die on all surfaces. The fired chill is then placed in the final core die designed to produce the outer contour of the finished core. The final core is then formed by pouring a ceramic slurry into the die with the chill inside.

The ceramic slurry encapsulates the chill and hardens onto it forming a skin. The ceramic powders used for the skin are comprised of the following:

| Dry Blend | Wt. % |
|---|---|
| −325 mesh Zircon | 18.80% |
| −200 mesh Fused Silica (MinSil-40) | 17.28% |
| 10 micron Fused Silica | 15.24% |
| −70/+100 mesh Fused Silica | 48.67% |

These ceramic powders are mixed with a liquid organometallic binder such as prehydrolised ethyl silicate in a ratio appropriate to form a low viscosity slurry. The solid/liquid ratio typically used is 4:1 resulting in a viscosity ranging from 700 to 1200 centipoise. Prior to pouring the ceramic slurry into the mold, it is combined with a basic catalyst such as ammonium hydroxide or morpholine which crosslinks the ethylsilicate producing a ceramic gel structure and effectively hardens the ceramic slurry in the shape of the core die cavity. The concentration of the catalyst is adjusted with water to allow for a working time of 3 to 5 minutes prior to hardening. The slurry/catalyst ratio typically used is 20:1 to 22:1 by volume. The slurry skin is ignited immediately upon opening the die (rapid heating to elevated temperature) to further harden the skin binder. After 20 to 30 second burn, the flames are extinguished by a blast of air, and the green core is removed from the die. Once the core has been removed from the die, it is placer on a controlled surface and re-ignited and allowed to completely burn out. This combustion process allows the alcohols in the binder to be removed and further hardens the core surface. The core is then impregnated with silica by soaking it in a 30% by weight aqueous colloidal silica sol. This colloidal silica sol is commercially marketed under the DuPont Ludox trade name. The cores are then placed in a dryer held at 180 to 200 degrees F. until the water is sufficiently removed. These cores may be dipped and dried once or numerous times in order to fill the pour structure of the core with amorphous silica. After the final dry cycle the cores are loaded back into the firing setter and subjected to a final sintering cycle for 1 to 2 hours at 1700 to 1800 degrees Fahrenheit.

Ten core test bars having a cross section thickness of 0.450" produced using example 4 exhibited an average pitch shrinkage of 0.19%. A core having a cross section thickness of 1.7" produced using example 4 exhibited a pitch shrinkage of 0.4%. The same core produced using no chill and the same material as in example 2 exhibited a pitch shrinkage of 1.6%.

Although the invention has been described with respect to certain embodiments thereof, those skilled in the art will appreciate that the invention is not limited to these embodiments and changes, modifications, and the like can be made therein within the scope of the invention as set forth in the appended claims.

We claim:

1. A ceramic core for making a gas turbine engine airfoil casting, comprising a fired chill having an airfoil section and smaller dimensions than that of said ceramic core and a thin ceramic skin on the fired chill to form a coated core having increased dimensions corresponding substantially to those desired for said ceramic core, said coated core having an airfoil pitch of one inch and greater and an airfoil pitch shrinkage of about 0.5% or less.

2. The core of claim 1 wherein said skin has a thickness of about 0.050 inch to about 0.200 inch.

* * * * *